US009207604B1

(12) United States Patent
Ise et al.

(10) Patent No.: US 9,207,604 B1
(45) Date of Patent: Dec. 8, 2015

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Tokihiko Ise, Shizuoka (JP); Satoshi Kinouchi, Tokyo (JP); Takaho Watanabe, Shizuoka (JP); Ryota Saeki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/529,325

(22) Filed: Oct. 31, 2014

(51) Int. Cl.
*G03G 15/20* (2006.01)

(52) U.S. Cl.
CPC ..... *G03G 15/2085* (2013.01)

(58) Field of Classification Search
CPC ..... G03G 15/2085; G03G 15/2064; G03G 2215/2003; G03G 2215/2006
See application file for complete search history.

(56) References Cited

U.S. PATENT DOCUMENTS

| | | | | |
|---|---|---|---|---|
| 6,125,248 | A * | 9/2000 | Moser | 399/68 |
| 2006/0157909 | A1 | 7/2006 | Terao et al. | |
| 2006/0245795 | A1* | 11/2006 | Kamiyama | 399/322 |
| 2007/0053731 | A1* | 3/2007 | Mori et al. | 399/341 |
| 2008/0298860 | A1* | 12/2008 | Omata | 399/321 |
| 2009/0010691 | A1* | 1/2009 | Shiozawa | 399/341 |
| 2010/0322655 | A1 | 12/2010 | Kikuchi et al. | |
| 2011/0085830 | A1* | 4/2011 | Suzuki | 399/322 |
| 2011/0135325 | A1* | 6/2011 | Hitaka et al. | 399/21 |
| 2011/0299895 | A1* | 12/2011 | Tsukioka | 399/322 |
| 2012/0051815 | A1* | 3/2012 | Satomi | 399/341 |
| 2015/0098097 | A1* | 4/2015 | Shoda et al. | 358/1.9 |

* cited by examiner

*Primary Examiner* — W B Perkey
(74) *Attorney, Agent, or Firm* — Amin, Turocy & Watson, LLP

(57) ABSTRACT

In accordance with one embodiment, an image forming apparatus comprises a fixing section, a pressing section, a plurality of nips, a plurality of conveyance paths, a switch section and a control section. The fixing section is heated through a heat source. The pressing section is pressed against the fixing section to form a nip. The plurality of nips are formed by at least one fixing section and at least one pressing section. The plurality of conveyance paths pass through at least one of the plurality of nips. The switch section switches the plurality of conveyance paths. The control section controls the switch section.

10 Claims, 3 Drawing Sheets

IMAGE FORMING APPARATUS

FIELD

Embodiments described herein relate generally to an image forming apparatus.

BACKGROUND

There is an image forming apparatus which conveys a sheet-like medium (hereinafter collectively referred to as a "sheet") such as paper and the like, and meanwhile, forms an image on the sheet. The image forming apparatus is provided with an image forming section for forming a visible image (toner image) with toner and a fixing device for fixing a toner image on the sheet through heat and pressure. However, there is a possibility that it is hard to reduce the time required to switch a fixing condition such as a temperature when executing a plurality of different fixing operations according to the category of the toner and the like.

DETAILED DESCRIPTION

Figure 1:
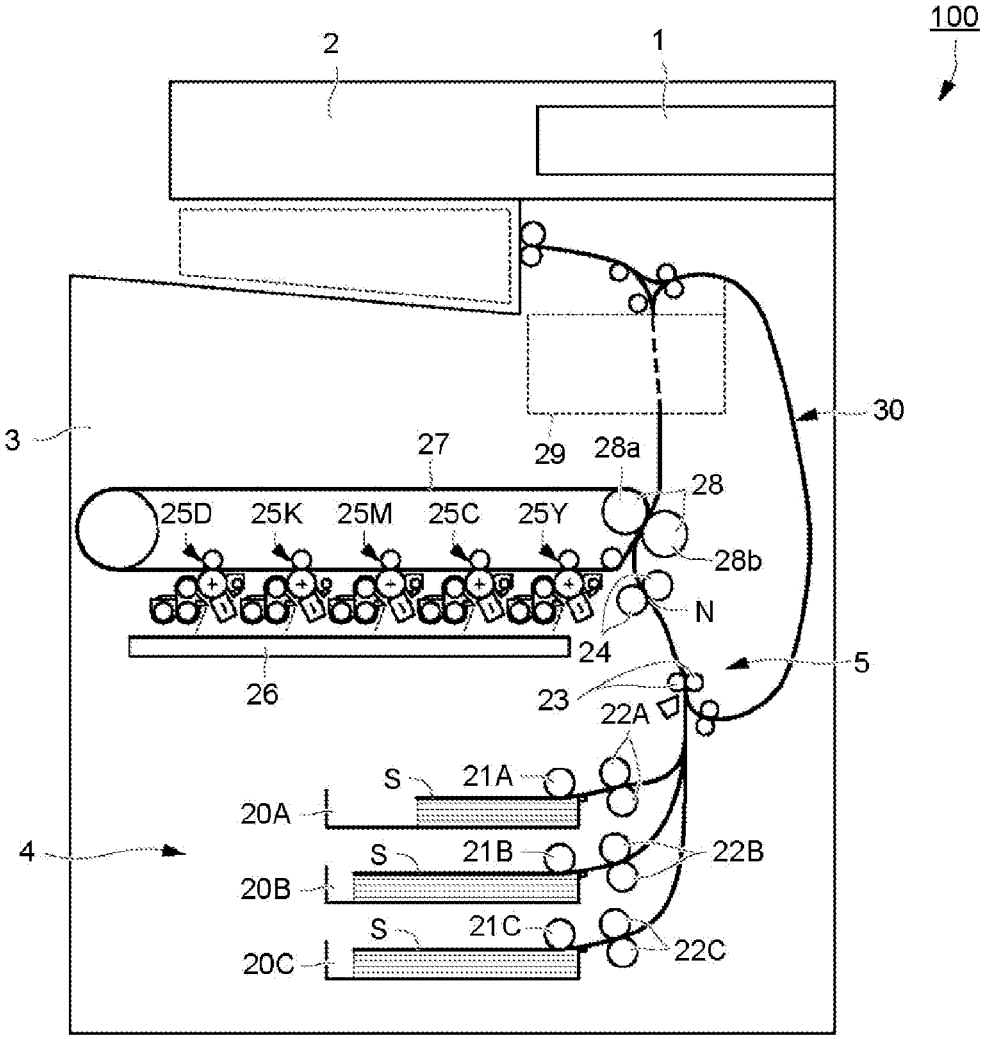
FIG. 1 is a schematic view of a cross section illustrating an example of the whole constitution of an image forming apparatus according to one embodiment.

In accordance with one embodiment, an image forming apparatus comprises a fixing section, a pressing section, a plurality of nips, a plurality of conveyance paths, a switch section and a control section. The fixing section is heated through a heat source. The pressing section is pressed against the fixing section to form a nip. The plurality of nips is formed by at least one fixing section and at least one pressing section. The plurality of conveyance paths pass through at least one of the plurality of nips. The switch section switches the plurality of conveyance paths. The control section controls the switch section.

Hereinafter, an image forming apparatus 100 according to the embodiment is described with reference to the accompanying drawings. Same components in each figure are applied with the same reference numerals.

FIG. 1 is a schematic view of a cross section illustrating an example of the whole constitution of the image forming apparatus 100 according to the embodiment.

As shown in FIG. 1, the image forming apparatus 100 includes a control panel 1, a scanner section 2, a printer section 3, a sheet storage section 4 and a conveyance section 5.

The scanner section 2 reads image information of a copy object as the brightness and darkness of light. The scanner section 2 outputs the read image information to the printer section 3.

The printer section 3 forms an output image (hereinafter referred to as a toner image) with developing agent (visualizing agent) such as toner and the like based on the image information from the scanner section 2 or an external device. The printer section 3 transfers the toner image to the surface of a sheet S. The printer section 3 applies heat and pressure to the toner image on the surface of the sheet S to fix the toner image on the sheet S.

The sheet storage section 4 supplies the sheet S one by one to the printer section 3 at the timing when the toner image is formed by the printer section 3. The sheet storage section 4 includes a plurality of paper feed cassettes 20A, 20B and 20C. Each of the paper feed cassettes 20A, 20B and 20C stores the sheets S of a preset size and category. Each of the paper feed cassettes 20A, 20B and 20C is provided with a pickup roller 21A, 21B and 21C. Each pickup roller 21A, 21B and 21C picks up one sheet S from each paper feed cassette 20A, 20B and 20C and supplies the picked up sheet S to the conveyance section 5.

The conveyance section 5 includes a conveyance roller and a register roller 24. The conveyance section 5 conveys the sheet S supplied from the pickup rollers 21A, 21B and 21C to the register roller 24. The register roller 24 conveys the sheet S at the timing when the printer section 3 is to transfer the toner image to the sheet S. The conveyance roller 23 abuts the front end in the conveyance direction of the sheet S against a nip N of the register roller 24. The conveyance roller 23 deflects the sheet S to align the position of the front end of the sheet S in the conveyance direction. The register roller 24 conveys the sheet S to a later-described transfer section 28 after the front end of the sheet S conveyed from the conveyance roller 23 is aligned in the nip N.

The printer section 3 includes a plurality of image forming sections 25Y, 25M, 25C, 25K and 25D, an exposure section 26, an intermediate transfer belt 27, a transfer section 28 and a fixing device 29.

Each of the plurality of image forming sections 25Y, 25M, 25C, 25K and 25D forms a toner image to be transferred to the sheet S. Each of the plurality of image forming sections 25Y, 25M, 25C, 25K and 25D includes a photoconductive drum (image carrier) and a developing device which selectively supplies toner to the surface of the photoconductive drum. The developing device stores inerasable yellow, magenta, cyan and black toner, and erasable toner. The erasable toner is fixed on the surface of each photoconductive drum at a given fixing temperature and is erased at a color erasing temperature higher than the given fixing temperature.

The exposure section 26 is arranged to face the photoconductive drum of each image forming section 25Y, 25M, 25C, 25K and 25D. The exposure section 26 irradiates the surface of the photoconductive drum of each image forming section 25Y, 25M, 25C, 25K and 25D with laser light based on the image information. The exposure section 26 develops, with toner, an electrostatic latent image (toner image) on the surface of the photoconductive drum of each image forming section 25Y, 25M, 25C, 25K and 25D. The image forming section 25Y develops yellow toner with the laser light from the exposure section 26. The image forming section 25Y forms a yellow toner image on the surface of the photoconductive drum. The image forming section 25M develops magenta toner with the laser light from the exposure section 26. The image forming section 25M forms a magenta toner image on the surface of the photoconductive drum. The image forming section 25C develops cyan toner with the laser light from the exposure section 26. The image forming section 25C forms a cyan toner image on the surface of the photoconductive drum. The image forming section 25K develops black toner with the laser light from the exposure section 26. The image forming section 25K forms a black toner image on the surface of the photoconductive drum. The image forming section 25D develops erasable toner with the laser light from the exposure section 26. The image forming section 25D forms an erasable toner image on the surface of the photoconductive drum.

Each of the image forming sections 25Y, 25M, 25C, 25K and 25D transfers (primarily transfers) the toner image on the surface of the photoconductive drum to the intermediate transfer belt 27. Each image forming section 25Y, 25M, 25C, 25K and 25D applies a transfer bias to the toner image at a primary transfer position thereof. Each image forming section 25Y, 25M, 25C and 25K overlaps and transfers the toner image of each color to the intermediate transfer belt 27. Each image forming section 25Y, 25M, 25C and 25K forms a color toner image on the intermediate transfer belt 27.

The transfer section 28 transfers the charged toner image on the intermediate transfer belt 27 to the surface of the sheet S at a secondary transfer position. The secondary transfer position is such a position where a support roller 28*a* and a secondary transfer roller 28*b* are arranged to face each other. The transfer section 28 applies a transfer bias corresponding to transfer current at the secondary transfer position. The transfer section 28 transfers the toner image on the intermediate transfer belt 27 to the sheet S through the transfer bias.

The fixing device 29 applies heat and pressure to the sheet S to fix the toner image transferred to the surface of the sheet S on the sheet S.

The printer section 3 further includes a reversal unit 30. The reversal unit 30 reverses the sheet S discharged from the fixing device 29 through a switchback. The reversal unit 30 conveys the reversed sheet S to a conveyance guide 5*a* in front of the register roller 24 again. The reversal unit 30 reverses the sheet S so that an image can be formed on the back side of the sheet S subjected to the fixing processing.

Figure 2:
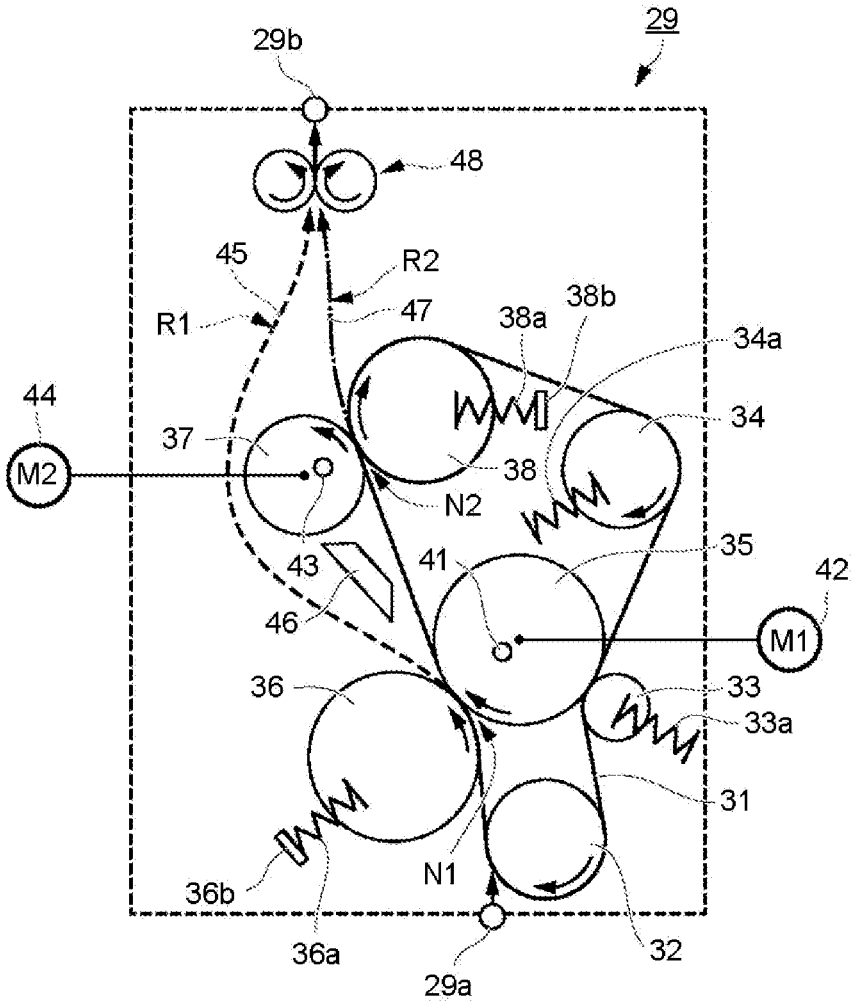
FIG. 2 is a schematic view illustrating an example of the constitution of a fixing device of the image forming apparatus according to the embodiment.

Hereinafter, the constitution of the fixing device 29 is described with reference to FIG. 2. FIG. 2 is a schematic view of a cross section illustrating an example of the constitution of the fixing device 29 of the image forming apparatus 100.

The fixing device 29 includes a fixing belt 31, a first belt roller 32, a second belt roller 33, a third belt roller 34, a first heating roller 35, a first pressing roller 36, a second heating roller 37 and a second pressing roller 38.

The fixing belt 31 formed by a flexible material is formed in an endless cylindrical shape. The first and the third belt rollers 32 and 34, the first heating roller 35 and the second pressing roller 38 are arranged inside the fixing belt 31. The inner peripheral surface of the fixing belt 31 is contacted with the outer peripheral surface of each of the first and the third belt rollers and 34, the first heating roller 35 and the second pressing roller 38. The outer peripheral surface of the fixing belt 31 is contacted with the outer peripheral surface of each of the second belt roller 33, the first pressing roller 36 and the second heating roller 37. The fixing belt 31 is stretched by the first belt roller 32, the first heating roller 35, the second pressing roller 38, the third belt roller 34 and then the first heating roller 35 in sequence in a belt rotation direction.

The first belt roller 32 is arranged closest to an inlet 29*a* of the sheet S. The first belt roller 32 is driven to rotate through the rotation of the fixing belt 31.

The second belt roller 33 nips the fixing belt 31 with the first heating roller 35. The second belt roller 33 is provided with a spring 33*a* which presses the second belt roller 33 against the first heating roller 35. The second belt roller 33 is driven to rotate through the rotation of the fixing belt 31.

The third belt roller 34 is provided with a tension spring 34*a* which presses the third belt roller 34 towards the outside of the fixing belt 31 to stretch the fixing belt 31.

The first heating roller 35 formed into a cylindrical shape is provided with a first heat generating section 41 inside. The first heat generating section 41 is, for example, a halogen lamp. The first heating roller 35 is connected with a first motor (M1) 42. The first heating roller 35 is rotated through the driving force of the first motor (M1) 42. The first heating roller 35 drives the fixing belt 31 to rotate.

The first pressing roller 36 is provided with a first tension spring 36*a* which presses the first pressing roller 36 against the first heating roller 35. The first tension spring 36*a* includes a first adjustment section 36*b* for adjusting the magnitude of the elastic force. The first adjustment section 36*b* includes, for example, a motor and a link mechanism or a cam mechanism. The link mechanism or the cam mechanism transfers the driving force of the motor to the first tension spring 36*a*. The first adjustment section 36*b* adjusts the magnitude of the elastic force of the first tension spring 36*a* through the driving force of the motor. The first pressing roller 36 contacts with the fixing belt 31 to form a first fixing nip N1.

The first pressing roller 36 and the first heating roller 35 apply heat and pressure to the sheet S passing through the first fixing nip N1.

The second pressing roller 38 and the second heating roller 37 are arranged at the downstream side of the first pressing roller 36 and the first heating roller 35 in the conveyance direction of the sheet S.

The second heating roller 37 formed into a cylindrical shape is provided with a second heat generating section 43 inside. The second heat generating section 43 is, for example, a halogen lamp. The second heating roller 37 is connected with a second motor (M2) 44. The second heating roller 37 is rotated through the driving force of the second motor (M2) 44. The second heating roller 37 drives the fixing belt 31 to rotate.

The second pressing roller 38 is provided with a second tension spring 38*a* which presses the second pressing roller 38 against the second heating roller 37. The second tension spring 38*a* includes a second adjustment section 38*b* for adjusting the magnitude of the elastic force. The second adjustment section 38*b* includes, for example, a motor and a link mechanism or a cam mechanism. The link mechanism or the cam mechanism transfers the driving force of the motor to the second tension spring 38*a*. The second adjustment section 38*b* adjusts the magnitude of the elastic force of the second tension spring 38*a* through the driving force of the motor. The second pressing roller 38 contacts the fixing belt 31 with the second heating roller 37 to form a second fixing nip N2.

The second pressing roller 38 and the second heating roller 37 apply heat and pressure to the sheet S passing through the second fixing nip N2.

The fixing device 29 includes a first discharge conveyance path 45 arranged between the first pressing roller 36 and the first heating roller 35, and the second pressing roller 38 and the second heating roller 37. The fixing device 29 further includes a switch gate 46 arranged at the downstream side of the first pressing roller 36 and the first heating roller 35 in the conveyance direction of the sheet S. The switch gate 46 switches the conveyance of the sheet S to a conveyance path along the fixing belt 31 or to the first discharge conveyance path 45.

The fixing device 29 includes a second discharge conveyance path 47 arranged at the downstream side of the second pressing roller 38 and the second heating roller 37 in the conveyance direction of the sheet S.

The fixing device 29 includes a mergence part 48 for merging the first discharge conveyance path 45 and the second discharge conveyance path 47 with each other at an outlet 29*b* of the sheet S.

The fixing device 29 includes a first fixing path R1 and a second fixing path R2 different in fixing operations carried out on the toner image of the sheet S. The first fixing path R1 of the fixing device 29 passes through the first fixing nip N1, the switch gate 46, the first discharge conveyance path 45 and the mergence part 48 in sequence. The second fixing path R2 of the fixing device 29 passes through the first fixing nip N1, the switch gate 46, the second fixing nip N2, the second discharge conveyance path 47 and the mergence part 48 in sequence. The fixing device 29 executes, on each path, fixing operations which are different from each other in one or a plurality of settings about the height of the processing temperature, the intensity of the processing pressure and the length of the pressure time. The fixing device 29 switches the length of the pressure time by switching the path or switching the magnitude of the conveyance speed.

The fixing device 29 sets, for example, the temperature of the first heating roller 35 in the first fixing path R1 to a first temperature. The fixing device 29 sets the temperature of the second heating roller 37 in the second fixing path R2 to a second temperature higher than the first temperature. The fixing device 29 switches the path of the sheet S to the first fixing path R1 or the second fixing path R2 through the switch gate 46.

The fixing device 29 sets, for example, the path of a first sheet S of which the fixing temperature is the first temperature to the first fixing path R1 through the switch gate 46. The first sheet S includes a toner image formed with the inerasable toner of which the fixing temperature is the first temperature. The fixing device 29 sets the path of a second sheet S of which the fixing temperature is the second temperature to the second fixing path R2 through the switch gate 46. The second sheet S includes a toner image formed with the inerasable toner of which the fixing temperature is the second temperature.

The fixing device 29 sets, for example, the path of a third sheet S of which the fixing temperature is the first temperature to the first fixing path R1 through the switch gate 46. The third sheet S includes a toner image formed with the erasable toner of which the fixing temperature is the first temperature. The fixing device 29 sets the path of a fourth sheet S of which the fixing temperature is the second temperature to the second fixing path R2 through the switch gate 46. The fourth sheet S includes a toner image formed with the erasable toner of which the fixing temperature is the second temperature.

The fixing device 29 sets, for example, the pressure applied to the sheet S passing through the first fixing nip N1 in the first fixing path R1 to a first pressure. The fixing device 29 sets the pressure applied to the sheet S passing through the second fixing nip N2 in the second fixing path R2 to a second pressure higher than the first pressure. The fixing device 29 switches the path of the sheet S to the first fixing path R1 or the second fixing path R2 through the switch gate 46.

The fixing device 29 sets, for example, the path of a fifth sheet S of which the fixing pressure is the first pressure to the first fixing path R1 through the switch gate 46. The fifth sheet S includes a toner image formed with the erasable toner of which the fixing pressure is the first pressure. The fixing device 29 sets the path of a sixth sheet S of which the color erasing pressure is the second pressure to the second fixing path R2 through the switch gate 46. The sixth sheet S includes a toner image formed with the erasable toner of which the color erasing pressure is the second pressure.

The fixing device 29 switches, for example, the time (pressure time) during which pressure is applied to the sheet S by switching the first fixing path R1 and the second fixing path R2. The fixing device 29 sets the pressure time for the sheet S passing through the first fixing nip N1 to a first time. The fixing device 29 sets the pressure time for the sheet S passing through the first fixing nip N1 and the second fixing nip N2 to a second time longer than the first time.

The fixing device 29 sets, for example, the path of a seventh sheet S of which the pressure time required for the fixing processing is the first time to the first fixing path R1 through the switch gate 46. The seventh sheet S includes a toner image formed with the erasable toner of which the pressure time required for the fixing processing is the first time. The fixing device 29 sets the path of an eighth sheet S of which the pressure time required for the color erasing processing is the second time to the second fixing path R2 through the switch gate 46. The eighth sheet S includes a toner image formed with the erasable toner of which the pressure time required for the color erasing processing is the second time.

The fixing device 29 switches, for example, the conveyance speed of the sheet S by switching the first fixing path R1 and the second fixing path R2. The fixing device 29 sets the conveyance speed of the sheet S in the first fixing path R1 to a first speed. The fixing device 29 sets the conveyance speed of the sheet S in the second fixing path R2 to a second speed higher than the first speed. The fixing device 29 switches the path of the sheet S through the switch gate 46 in a state in which the speed of the fixing belt 31 is set to the first speed or the second speed.

The fixing device 29 sets, for example, the path of the sheet S of which the conveyance speed is the first speed to the first fixing path R1 through the switch gate 46. The fixing device 29 sets the path of the sheet S of which the conveyance speed is the second speed to the second fixing path R2 through the switch gate 46.

Figure 3:
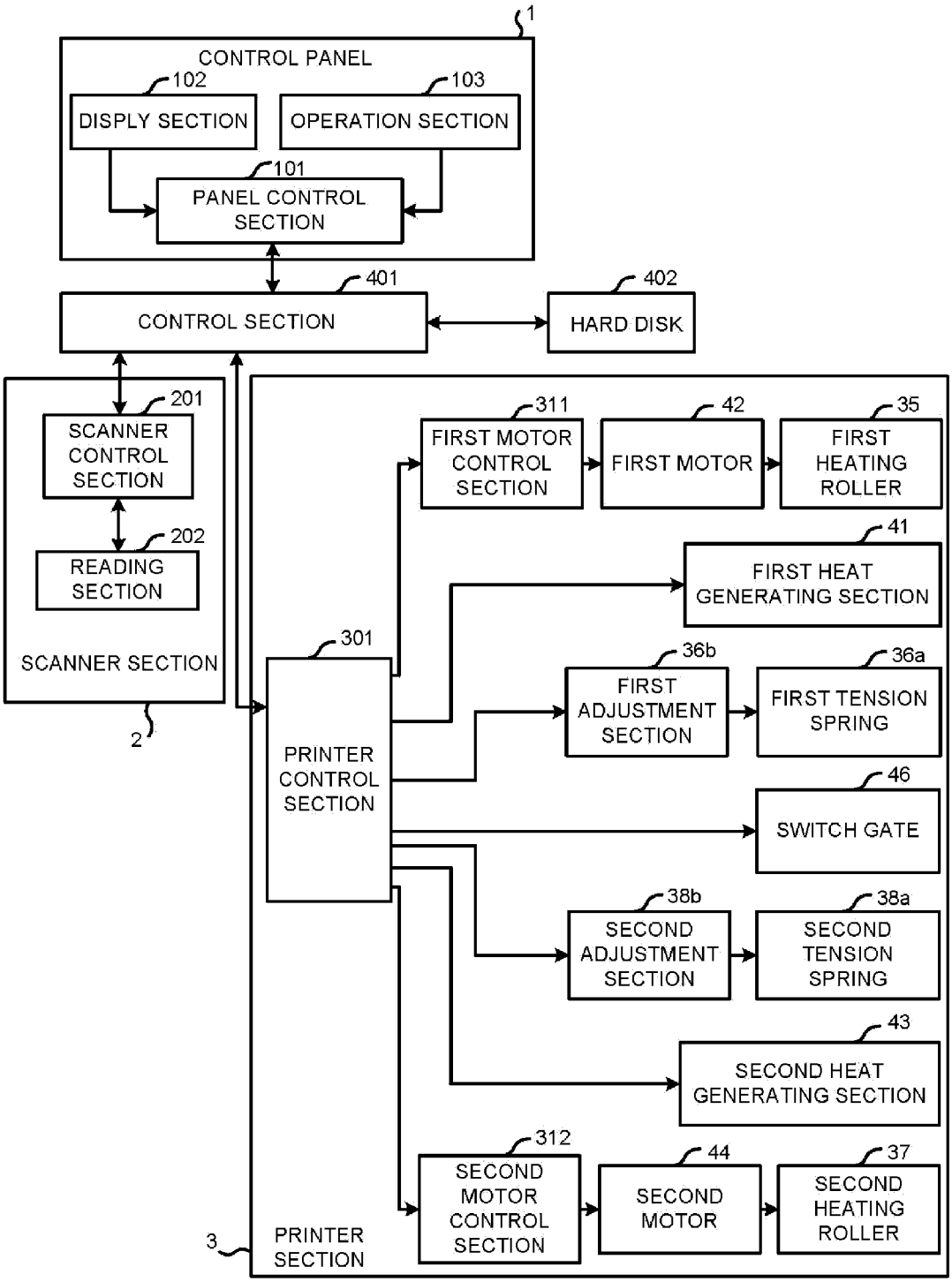
FIG. 3 is a block diagram illustrating an example of the constitution of one part of the image forming apparatus according to the embodiment.

Hereinafter, the constitution of the image forming apparatus 100 is described with reference to FIG. 3. FIG. 3 is a block diagram illustrating an example of the constitution of one part of the image forming apparatus 100.

The control panel 1, the scanner section 2 and the printer section 3 are connected with a control section 401. The control section 401 controls the CPU of each of the control panel 1, the scanner section 2 and the printer section 3 described later. The control section 401 controls the whole operations of the image forming apparatus 100. The control section 401 includes a CPU, an ROM and an RAM. The control section 401 is connected with a hard disk 402.

The hard disk 402 stores the image information sent from the scanner section 2 or the external device.

The control panel 1 includes a panel control section 101, a display section 102 and an operation section 103. The panel control section 101 includes a CPU, an ROM and an RAM. The panel control section 101 controls the control panel 1.

The display section 102 outputs a screen corresponding to the operation content or an image corresponding to an instruction from the panel control section 101.

The operation section 103 receives an operation from a user and outputs a signal indicating the operation content to the panel control section 101. The operation section 103 includes various keys.

The display section 102 and the operation section 103 may be a touch panel type display in which the display section and the operation section are arranged integrally. The panel control section 101 displays the information relating to the operation of the printer section 3 such as the selection of toner, the category of the sheet S, the size of the sheet S, and the number of printings on the display section 102. The operation section 103 receives an operation for designating and changing the information displayed on the display section 102. The operation section 103 receives, for example, the designation of the information relating to the operations of the printer section 3.

The operation section 103 outputs the designated information relating to the operations of the printer section 3 to a printer control section 301. The printer control section 301 includes a CPU, an ROM and an RAM. The printer control section 301 writes the designated information relating to the operations of the printer section 3 in the RAM arranged inside.

The scanner section 2 includes a scanner control section 201 and a reading section 202. The scanner control section 201 includes a CPU, an ROM and an RAM. The scanner control section 201 controls the reading section 202 to read the image information.

The printer section 3 includes the printer control section 301. The printer control section 301 includes a CPU, an ROM and an RAM. The printer control section 301 controls the printer section 3 to print the image on the sheet S.

The printer control section 301 controls the operation of a first motor control section 311 for the first heating roller 35. The first motor control section 311 controls the operation of a first motor 42 connected with the first heating roller 35. The printer control section 301 controls the operation of a second motor control section 321 for the second heating roller 37. The second motor control section 321 controls the operation of a second motor 44 connected with the second heating roller 37.

The printer control section 301 receives the information relating to the operations of the printer section 3 output from the operation section 103 or the external device. The printer control section 301 controls the operation of each of the first motor control section 311 and the second motor control section 321 according to the information relating to the operations of the printer section 3. In this way, the printer control section 301 sets the speed of the fixing belt 31 to the first speed or the second speed according to the information relating to the operations of the printer section 3.

The printer control section 301 controls the operation of the first heat generating section 41 for the first heating roller 35. The printer control section 301 sets the temperature of the first heating roller 35 to the first temperature. The printer control section 301 controls the operation of the second heat generating section 43 for the second heating roller 37. The printer control section 301 sets the temperature of the second heating roller 37 to the second temperature. The printer control section 301 switches the path of the sheet S through the switch gate 46 according to the information relating to the operations of the printer section 3 to switch the temperature applied to the sheet S.

The printer control section 301 controls the operation of the first adjustment section 36*b* for the first tension spring 36*a*. The first adjustment section 36*b* controls the elastic force of the first tension spring 36*a*. The printer control section 301 controls the operation of the second adjustment section 38*b* for the second tension spring 38*a*. The second adjustment section 38*b* controls the elastic force of the second tension spring 38*a*. The printer control section 301 sets the pressure applied to the sheet S in the first fixing nip N1 to the first pressure. The printer control section 301 sets the pressure applied to the sheet S in the second fixing nip N2 to the second pressure. The printer control section 301 switches the path of the sheet S through the switch gate 46 according to the information relating to the operations of the printer section 3 to switch the pressure applied to the sheet S.

The printer control section 301 switches the path of the sheet S through the switch gate 46 according to the information relating to the operations of the printer section 3 to switch the pressure time applied to the sheet S.

The image forming apparatus 100 according to the embodiment described above includes the first fixing path R1 and the second fixing path R2, thus, the efficiency of the processing that requires the switch of the fixing operation can be improved. The image forming apparatus 100 is provided with the first fixing path R1 passing through the first fixing nip N1 and the second fixing path R2 passing through the first fixing nip N1 and the second fixing nip N2, thus, the switch of the fixing operation is much more easier. The image forming apparatus 100 is provided with the switch gate 46 for switching the path according to the information relating to the operations of the printer section 3, thus, the fixing operation can be switched in a shorter time compared with a case of changing the operation content. Even in a case in which the sheets S having different processing conditions are mixed, the fixing processing can be completed rapidly by switching the path, which can improve the efficiency of the processing.

The image forming apparatus 100 is provided with the first fixing path R1 and the second fixing path R2 different in the height of the processing temperature, thus, the height of the processing temperature can be switched in a shorter time compared with a case of changing the temperature. Even in a case in which the sheets S different in the height of the processing temperature are mixed, the fixing processing can be completed rapidly by switching the path, which can improve the efficiency of the processing. For example, even in a case in which the sheet S printed with the inerasable toner is mixed with the sheet S printed with the erasable toner, the fixing processing can be completed rapidly by switching the path.

The image forming apparatus 100 is provided with the first fixing path R1 and the second fixing path R2 different in the magnitude of the processing pressure, thus, the magnitude of the processing pressure can be switched in a shorter time compared with a case of changing the pressure. Even in a case in which the sheets S different in the magnitude of the processing pressure are mixed, the fixing processing can be completed rapidly by switching the path, which can improve the efficiency of the processing.

The image forming apparatus 100 is provided with the first fixing path R1 and the second fixing path R2 different in the length of the pressure time, thus, the length of the pressure time can be switched in a shorter time compared with a case of changing the pressure time. Even in a case in which the sheets S different in the length of the pressure time are mixed, the fixing processing can be completed rapidly by switching the path, which can improve the efficiency of the processing.

The image forming apparatus 100 is provided with the first fixing path R1 and the second fixing path R2 different in the conveyance speed, thus, the fixing operation can be switched flexibly.

The image forming apparatus 100 is provided with the first fixing path R1 and the second fixing path R2, thus, the height of the processing temperature, the intensity of the processing pressure and the length of the pressure time can be switched easily.

The image forming apparatus 100 is provided with the switch gate 46 for switching the path of the sheet S in the fixing processing of a plurality of categories of toner having different fixing temperatures, thus, the efficiency of the fixing processing that requires the switch of the fixing temperature can be improved.

The image forming apparatus 100 is provided with the switch gate 46 for switching the path of the sheet S in the processing of the toner different in the fixing temperature and the color erasing temperature, thus, the efficiency of the processing that requires the switch of the fixing temperature and the color erasing temperature can be improved.

The image forming apparatus 100 is provided with the switch gate 46 between the first heating roller 35 and the second heating roller 37, thus, the height of the processing temperature, the intensity of the processing pressure and the length of the pressure time can be switched easily.

Hereinafter, a modification of the embodiment is described.

The image forming apparatus 100 according to the embodiment described above is provided with two fixing paths (that is, the first fixing path R1 and the second fixing path R2) different in the fixing operations, however, the present invention is not limited to this.

The image forming apparatus 100 may be provided with three or more fixing paths different in the fixing operations.

In the image forming apparatus 100 according to the embodiment described above, the switch gate 46 is controlled by the printer control section 301 according to the information relating to the operations of the printer section 3, however, the present invention is not limited to this.

In the image forming apparatus 100, the switch gate may be controlled by one or a plurality of other control sections instead of by the printer control section 301.

The image forming apparatus 100 according to the embodiment described above is provided with the image forming section 25K for forming a black toner image, however, the present invention is not limited to this.

The image forming apparatus 100 may not include the image forming section 25K, and in this case, the image forming apparatus 100 overlaps the yellow, the magenta and the cyan toner images to form a black toner image.

In accordance with at least one embodiment described above, the image forming apparatus 100 is provided with a plurality of fixing paths which pass through at least one nip, thus, the efficiency of the processing that requires the switch of the operation can be improved. The image forming apparatus 100 is provided with the switch gate 46 for switching the path of the sheet S according to the information relating to the operations of the printer section 3, thus, the fixing operation can be switched in a shorter time compared with a case of changing the operation content. Even in a case in which the sheets S having different processing conditions are mixed, the fixing processing can be completed rapidly by switching the path, which can improve the efficiency of the processing.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a fixing section configure to be heated through a heat source;

a pressing section configure to be pressed against the fixing section to form a nip;

a plurality of nips configure to be formed by at least one fixing section and at least one pressing section;

a plurality of conveyance paths configure to pass through at least one of the plurality of nips;

a switch section configure to switch the plurality of conveyance paths;

a control section configure to control the switch section;

a first nip of the plurality of nips; and a second nip of the plurality of nips located downstream from the first nip in a conveyance direction, wherein the first nip has a lower processing temperature and processing pressure than the second nip.

2. The image forming apparatus according to claim 1, wherein the plurality of conveyance paths are different in processing temperature.

3. The image forming apparatus according to claim 1, wherein the plurality of conveyance paths are different in processing pressure.

4. The image forming apparatus according to claim 1, wherein the plurality of conveyance paths are different in pressure time.

5. The image forming apparatus according to claim 1, wherein the plurality of conveyance paths are different in conveyance speed.

6. The image forming apparatus according to claim 1, wherein the plurality of conveyance paths are different in the number of heating rollers arranged therein.

7. The image forming apparatus according to claim 1, wherein the switch section selects any of the plurality of conveyance paths in the fixing processing of each of a plurality of categories of visualizing agent different in fixing temperature at least.

8. The image forming apparatus according to claim 1, wherein the switch section selects any of the plurality of conveyance paths in each of the fixing processing and the color erasing processing of the visualizing agent different in fixing temperature and the color erasing temperature at least.

9. The image forming apparatus according to claim 1, wherein the plurality of conveyance path includes a first conveyance path provided with a first heating roller, and a second conveyance path provided with the first heating roller and a second heating roller arranged at the downstream side of the first heating roller; and the switch section is arranged between the first heating roller and the second heating roller to select the first conveyance path or the second conveyance path.

10. The image forming apparatus according to claim 1, wherein the control section controls the switch section according to a command signal input by an operator.

* * * * *